United States Patent [19]

Annis et al.

[11] Patent Number: 4,958,541

[45] Date of Patent: Sep. 25, 1990

[54] ELECTRONIC TORQUE WRENCH WITH TACTILE INDICATION

[75] Inventors: Jeffrey R. Annis, Waukesha; Timm R. Herman, Kenosha; Ronald T. Strobel, South Milwaukee, all of Wis.

[73] Assignee: Snap-on Tools Corporation, Kenosha, Wis.

[21] Appl. No.: 421,407

[22] Filed: Oct. 13, 1989

[51] Int. Cl.[5] ..... B25B 23/144

[52] U.S. Cl. ..... 81/479

[58] Field of Search ..... 81/479; 173/12; 73/862.23

[56] References Cited

U.S. PATENT DOCUMENTS 3,546,933 12/1970 Grabovac ..... 73/862.23 X
3,970,155 7/1976 Otto .
4,112,749 9/1978 Smith ..... 73/862.23
4,244,434 1/1981 Wilson .
4,314,490 2/1982 Stone .
4,328,709 5/1982 Schramm .
4,558,601 12/1985 Stasiek et al. .
4,608,872 12/1986 Mayer et al. .

*Primary Examiner*—James G. Smith
*Attorney, Agent, or Firm*—Emrich & Dithmar

[57] ABSTRACT

An electronic torque wrench has a hollow handle portion in which are disposed a DC motor mechanically coupled to the handle portion with a mass eccentrically mounted on its shaft, a control circuit for the motor and a battery for powering the motor and the control circuit. A strain sensor on the wrench produces an output signal when the torque applied to a workpiece equals or exceeds a predetermined torque level for causing the control circuit to actuate the motor to vibrate the handle portion and provide a tactile indication to the user.

20 Claims, 3 Drawing Sheets

ELECTRONIC TORQUE WRENCH WITH TACTILE INDICATION

BACKGROUND OF THE INVENTION

1. Field of the Invention

The present invention relates to torque wrenches of the type which produce an indication of the torque level applied by the wrench to an associated workpiece. In particular, the present invention relates to electronic torque wrenches of the type which produce an output signal when the torque applied equals or exceeds a predetermined torque level.

2. Description of the Prior Art

Electronic torque wrenches typically include an elongated deflection beam provided at one end with a head portion for coupling to an associated workpiece, such as a threaded fastener or the like, and provided at the other end with an elongated handle. Strain gauges are mounted on the deflection beam to measure the strain or deflection of the beam in response to forces applied to the handle by the operator in applying torque to an associated workpiece. Typically, the strain gauges are connected in an electronic circuit which produces an indication of the torque applied to the workpiece as a function of the measurements made by the strain gauges. Output signals may be produced, either directly indicating the amount of torque applied, or indicating when the torque applied equals or exceeds a predetermined torque level.

In prior art torque wrenches, various types of indications have been utilized. Meters or gauges may give direct visual indications of the torque level applied, or may give a visual indication, such as by an illumination of a lamp or the like when a predetermined torque level is exceeded. It is also known to provide audible alarm signals to indicate that the predetermined torque level has been exceeded.

Torque wrenches are commonly used by mechanics, such as auto mechanics, who are frequently working in confined spaces, such as beneath a motor vehicle. In such circumstances, either because of the space limitations of the work area or the available light level, or both, he may be unable to see a visual indication on the wrench. For example, such mechanics frequently use torque wrenches in situations where the visual indicator on the wrench is facing away from the user in use, so that it cannot be seen by him. Also, auto repair shops and the like, where torque wrenches are commonly used, are typically noisy environments, with vehicle engines running, power tools being operated and the like, so as to create a level of background noise which makes it difficult or impossible for the operator to clearly hear an audible indication from the torque wrench.

SUMMARY OF THE INVENTION

It is a general object of the present invention to provide an improved torque wrench which avoids the disadvantages of prior wrenches, while affording additional structural and operating advantages.

An important feature of the present invention is the provision of a torque wrench which provides an unambiguous indication when the applied torque exceeds a predetermined torque level, which indication can clearly be sensed irrespective of the operating position of the user and the wrench and irrespective of the ambient noise and light levels.

In connection with the foregoing feature, it is another feature of the invention to provide a torque wrench of the type set forth, which affords a tactile indication to the user.

In connection with the foregoing feature, still another feature of the invention is the provision of a torque wrench which effects a vibration of the wrench to provide an indication signal to the user.

In connection with the foregoing features, another feature of the invention is the provision of a torque wrench of the type set forth, in which the vibration is effected by a motor rotating an unbalanced mass.

Still another feature of the invention is the provision of a torque wrench of the type set forth, in which the indication means is entirely confined within the torque wrench handle.

Yet another provision of the invention is the provision of a torque wrench of the type set forth in which the torque wrench is electronic and the indication means is battery powered.

These and other features of the invention are attained by providing, in a torque wrench having sensing apparatus for producing an output signal when the torque transmitted to an associated workpiece equals or exceeds a predetermined torque level, the improvement comprising: generating means for producing a tactile indication, and control means responsive to the output signal for activating the generating means.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
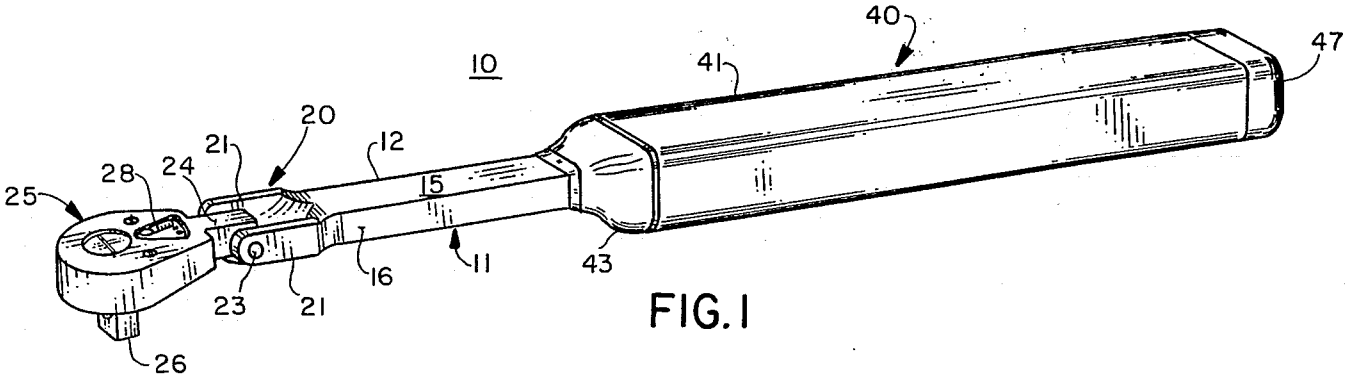
FIG. 1 is a perspective view of a torque wrench constructed in accordance with and embodying the features of the present invention.
Figure 2:
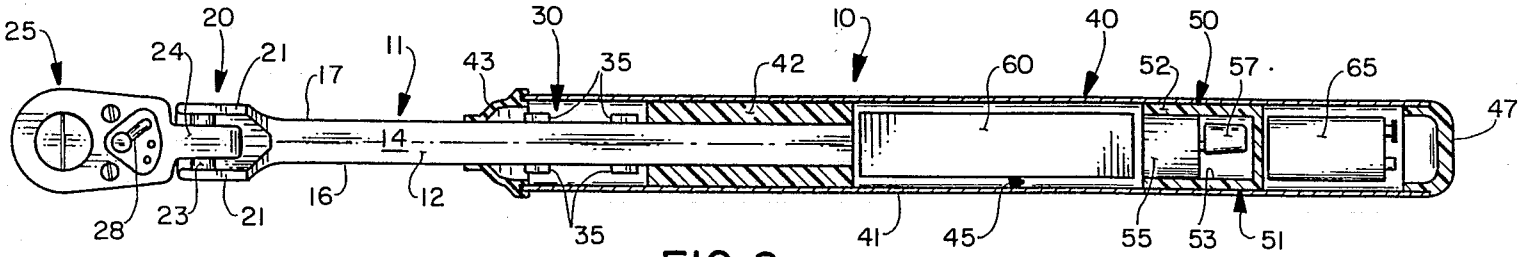
FIG. 2 is a top plan view of the torque wrench of FIG. 1, in partial horizontal section, illustrating the configuration of the handle portion and the components disposed therein.
Figure 3:
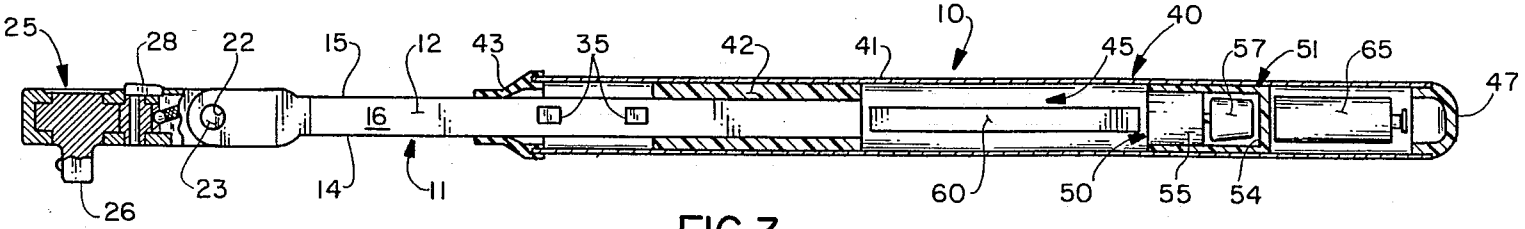
FIG. 3 is a view of the torque wrench of FIG. 1 in partial side elevational and partial vertical section.

Referring to FIGS. 1–3, there is illustrated an electronic torque wrench, generally designated by the numeral 10, constructed in accordance with and embodying the features of the present invention. The torque wrench 10 includes a flexure member in the form of an elongated deflection beam 11, which is substantially rectangular in transverse cross section. The deflection beam 11 includes an elongated shank 12 substantially rectangular in transverse cross section and having parallel front and rear surfaces 14 and 15 integral at the side edges thereof with parallel side surfaces 16 and 17. While, for purposes of illustration, a simplified form of deflection beam has been illustrated, it will be appreciated that other shapes could be utilized. In particular, there could be utilized the shape of deflection beam illustrated in copending U.S. application Ser. No. 252,659, filed Oct. 3, 1988, entitled "Torque Wrench with Measurements Independent of Hand-Held Position".

The deflection beam 11 is provided at one end thereof with a yoke 20, which comprises a pair of clevis legs 21 unitary with the shank 12 and provided with coaxial bores 22 therethrough. A pivot pin 23 extends through the bores 22 and through a tongue 24 of a ratchet head 25, the tongue 24 being received between the clevis legs 21 for pivotal movement of the ratchet head 25 with respect to the deflection beam 11. The ratchet head 25 is of standard construction having a rotatable drive lug 26 projecting from the front side thereof and provided with a direction control lever 28 on the rear side thereof, all in a well known manner. While a ratchet drive is illustrated, the wrench 10 could alternatively be provided with a head having a fixed square drive.

Mounted on the deflection beam 11 is a strain gauge assembly 30, which includes a plurality of strain gauges 35 fixedly secured to the deflection beam 11 in a predetermined configuration. In the illustrated embodiment, two of the strain gauges 35 are shown mounted at longitudinally spacedapart locations on one of the side surfaces 16 of the deflection beam 11, and two are similarly mounted on the opposite side surface 17. However, it will be appreciated that other strain gauge assembly configurations could be utilized, with different numbers of strain gauges and different positioning thereof. For example, the strain gauge arrangement illustrated in the aforementioned co-pending U.S. application Ser. No. 252,659 could be utilized.

The torque wrench 10 also has a handle assembly 40, which includes an elongated hollow tube 41 substantially rectangular in transverse cross section. The shank 12 of the deflection beam 11 is received in one end of the tube 41 and is preferably fixedly secured to a mounting block or holder 42, which may be formed of plastic, and is fixedly secured by suitable means to the tube 41. A flexible sleeve 43, formed of a suitable resilient material, such as rubber, is disposed at the one end of the tube 41. The sleeve 43 is generally conical in shape, having a large end fixedly secured to the adjacent end of the tube 41 around the entire perimeter thereof, and a reduced end which is disposed in engagement with the shank 12 of the deflection beam 11 around the perimeter thereof, for cooperation therewith to close the adjacent end of the tube 41. The tube 41 defines a hollow cavity 45 rearwardly of the mounting block 42 and is provided with a removable end cap 47 for closing the rear end of the tube cavity 45.

Figure 7:
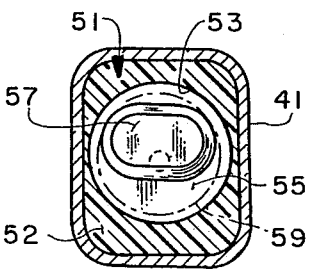
FIG. 7 is a view in vertical section taken along the line 7—7 in FIG. 6.
Figure 6:
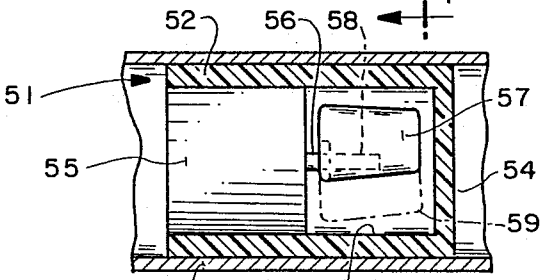
FIG. 6 is an enlarged, fragmentary view in horizontal section of the portion of the handle of the wrench of FIG. 1 containing the vibratory motor.
Figure 5:
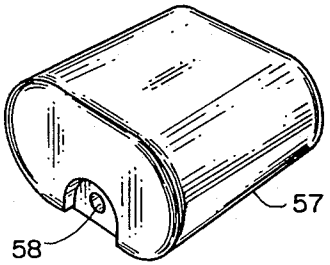
FIG. 5 is an enlarged, perspective view of the mass which is mounted on the motor of the torque wrench of FIG. 1.

Disposed within the cavity 45 is a tactile indication generator 50 in accordance with the present invention. Referring now also to FIGS. 5–7, the indication generator 50 includes a generally cup-shaped holder 51, formed of a suitable material, such as plastic, and fixedly secured by suitable means to the inner surface of the tube 41. The holder 51 comprises a body 52 having a circularly cylindrical bore 53 formed in one end thereof to define an end wall 54. Received in the open end of the bore 53 is an electric motor 55 provided with a shaft 56 which projects into the bore 53 toward the end wall 54. Preferably, the motor 55 is fixed to the holder 51 by suitable means. The motor 55 is a DC motor and may be an 18-volt motor of the type sold by Mabuchi Motor Co., Ltd. under Model no. 2805.

Fixedly secured to the shaft 56 is a mass 57, which may be formed of rubber, and is disposed eccentrically with respect to the shaft 56. More particularly, referring to FIGS. 5–7, the mass 57 may be generally trapezoidal in transverse cross section and be provided with an elongated bore 58 formed in one end thereof adjacent to one side thereof for receiving the shaft 56. Thus, it will be appreciated that the mass 57 is unbalanced on the motor shaft 56 and will rotate with the shaft 56 to sweep a cylinder of rotation 59 within the cup 51. Because the mass 57 is eccentrically mounted and unbalanced, as it rotates it will tend to vibrate the motor 55, and thereby the holder 51 and the tube 41.

Also disposed in the cavity 45 forwardly of the holder 51 is a circuit board 60, which carries the electronic circuitry of the torque wrench 10. The electronic circuitry may include suitable visual readout means (not shown) for giving visual indications of actual torque measure and/or reference torque levels in a known manner. Disposed in the cavity 45 rearwardly of the holder 51 is an appropriate battery 65, or a suitable battery pack. It will be appreciated that suitable electrical connections, not illustrated in FIGS. 2 and 3, are formed among the battery 65, the motor 55, the circuit board 60 and the strain gauge assembly 30.

Figure 4:
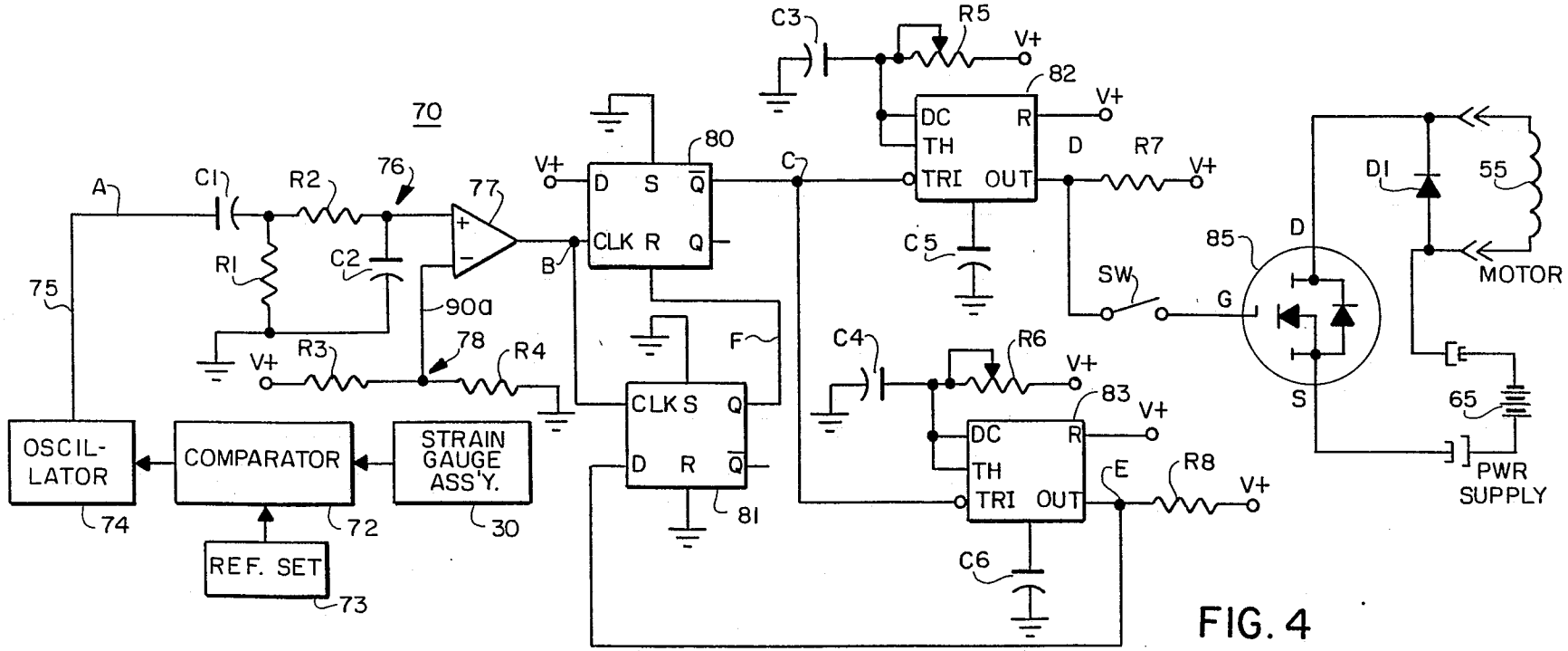
FIG. 4 is a partially schematic and partially block circuit diagram of the control circuit for the torque wrench of FIG. 1.

Referring now to FIG. 4, there is illustrated a control circuit 70 for the tactile indication generator 50, which diagrammatically illustrates the aforementioned circuit connections. The strain gauge assembly 30 outputs an analog signal proportional to the torque level applied by the wrench 10, which signal is applied to one input of a suitable comparator 72, the other input of which receives a reference signal from a reference-setting circuit 73. The reference setting circuit 73 may include a suitable manually-operable dial or the like (not shown) for manually setting a reference level corresponding to a predetermined torque level. The output of the comparator 72 is applied to a suitable oscillator 74, which produces an oscillatory signal. A suitable audible indicator such as a horn, speaker, buzzer or the like (not shown) may be coupled to the oscillator 74, if desired. Visual indication means (not shown), such as an LED readout, lamp or the like may also be provided. Thus, the strain gauge assembly 30, the comparator 72, the reference setting circuit 73 and the oscillator 74 form a sensing circuit which can provide an AC output signal when the applied torque exceeds the reference level. This sensing circuit is, of course, also powered by the battery 65 in a known manner.

The signal from the oscillator 74 is applied, via the conductor 75, to one terminal of a capacitor C1, which forms a part of a filter circuit 76. More specifically, the filter circuit 76 additionally includes a resistor R1 which is connected between the other terminal of the capacitor C1 and ground, and the series combination of a resistor R2 and a capacitor C2 which is connected in parallel with the resistor R1. The purpose of the filter circuit 76 is to minimize false triggering from transients or noise.

The junction between the resistor R2 and the capacitor C2 is connected to the non-inverting input terminal of an op-amp used as a comparator 77, the inverting terminal of which is connected to the junction between resistors R3 and R4, which are connected in series between the V+ supply and ground, and form a level or threshold adjusting network 78.

The output of the comparator 77 is connected to the clock input terminals CLK of two integrated-circuit D-type flip-flop circuits 80 and 81. The set terminals S of the flip-flop circuits 80 and 81 are coupled to ground, as is the reset terminal R of the circuit 81. The D terminal of the circuit 80 is connected to the V+supply, which may be provided by a suitable power supply circuit (not shown) coupled to the battery 65, which power supply circuit may be of the type illustrated in the aforementioned co-pending U.S. application Ser. No. 252,659. The Q output terminal of the circuit 81 is connected to the reset terminal of the circuit 80.

The Q inverse output of the circuit 80 is connected to the trigger input terminals TRI of two integrated circuit timers 82 and 83, which are respectively coupled through suitable capacitors C5 and C6 to ground. The reset terminals R of the circuits 82 and 83 are connected to the V+ supply. The threshold terminal TH and the DC terminal of the circuit 82 are connected to the junction between a capacitor C3 and a potentiometer R5, which are connected in series between the V+ supply and ground and form an RC timing circuit for controlling the period of the timer 82. Similarly, the DC and TH terminals of the timer 83 are connected to the junction between a capacitor C4 and a potentiometer R6, which are connected in series between the V+ supply and ground to control the period of the timer 83.

The output terminal OUT of the timer 83 is connected through a resistor R8 to the V+ supply and is also connected to the D terminal of the flip-flop circuit 81. The output terminal OUT of the timer 82 is connected through a resistor R7 to the V+supply and is also connected through an optional switch SW to the gate input terminal G of a power MOSFET electronic switch 85. The motor 55 and the battery 65 are connected in series between the source and drain terminals S and D of the switch 85. A diode D1 is connected across the terminals of the motor 55 to protect the switch 85 from negative induced voltage spikes when the motor 55 is turned off. It will be appreciated that other control circuits could be used to obtain substantially the same results as the control circuit 70.

Figure 8:
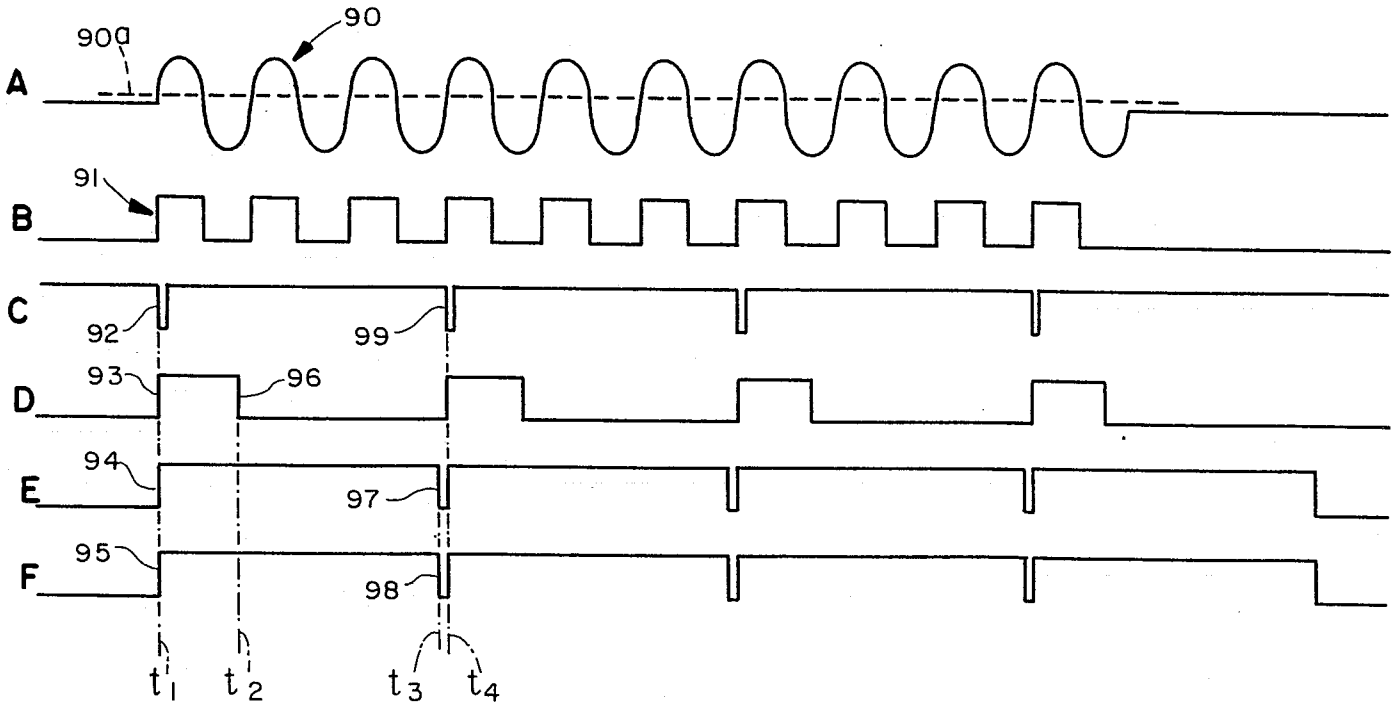
FIG. 8 is a series of waveform diagrams illustrating the operation of the circuit of FIG. 4.

Referring now also to FIG. 8, the operation of the control circuit 70 will be explained in detail. The waveforms labeled A through F in FIG. 8 illustrate the signals present at the correspondingly labeled points in the control circuit 70 of FIG. 4. In use, the operator couples the ratchet head 25 to the workpiece, grasps the handle assembly 40, and applies torque to the workpiece. This causes stress in the deflection beam 11, resulting in a corresponding deflection or strain. This strain is sensed by the strain gauge assembly 30, which outputs an analog signal to the comparator 72. When the torque applied to the workpiece exceeds the predetermined torque level corresponding to the reference level set in the reference-setting circuit 73, the comparator 72 will produce an output signal to actuate the oscillator 74. The oscillator 74 produces a signal 90, illustrated in waveform A, which is applied through the filter circuit 76 to the comparator 77, to which is also applied a reference level voltage **90*a* from the threshold adjusting network 78. The comparator 77 produces at its output a square wave signal 91, illustrated in waveform B, which goes from low to high at each positive-going transition of the waveform 90 through the reference level 90*a*, and goes from high to low at each negative going transition through that reference level. The waveform 91 provides a clock input signal to the flip-flop circuits 80 and 81** to enable those circuits.

The Q output of the flip-flop circuit 81 is normally low, holding the flip-flop circuit 80 reset. Thus, when the clock signal 91 appears to enable the flip-flop circuits 80 and 81, the Q inverse output of the circuit 80 will momentarily go low at time t as illustrated at 92 of waveform C, to provide a trigger pulse to the timers 82 and 83. When the timer circuit 82 is triggered, its output will go high, as at 93 of waveform D, and will remain high for a time period determined by the RC timing circuit of capacitor C3 and potentiometer R5. This high level output from the timer 82 is applied to the gate terminal of the switch 85 to render it conductive and energize the motor 55, causing its output shaft to rotate. This rotation will, in turn, rotate the mass 57 to vibrate the handle assembly 40. The motor 55 will remain energized until the timer 82 times out at time $t_2$, indicated at 96 of waveform D.

When the timer 83 is triggered, its output will go high, as at 94 of waveform E, and remain high for the time period determined by the RC timing circuit of capacitor C4 and potentiometer R6, which time period will be set to be longer than that of the timer 82. The high output from the timer 83 is applied to the D input terminal of the flip-flop circuit 81, causing its Q output to go high, as at 95 of waveform F.

When the timer 83 times out, its output will go low at time $t_3$, as indicated at 97 in waveform E, causing the Q output of the flip-flop circuit 81 to go low, as at 98 of waveform F, to again reset the flip-flop circuit 80. If the enabling clock signal 91 is still present, the Q inverse output terminal of the flip-flop circuit 80 will again go momentarily low at time $t_4$ as indicated at 99 in waveform C, to retrigger the timers 82 and 83 and repeat the cycle.

Thus, it will be appreciated that, as long as the enabling clock signal 91 is present, i.e., as long as the applied torque level exceeds the predetermined reference torque level, the motor 55 will be alternately cycled on and off to provide a pulsating or intermittent vibration of the handle assembly 40, which provides a tactile indication to the user that the predetermined reference torque level has been reached. If the user then reduces the force applied to the torque wrench 10, the applied torque will drop below the reference level, the flip-flop circuits 80 and 81 will be disabled and the pulsating vibration of the motor 55 will cease.

In a constructional model of the present invention, the weight of the mass 57 is about 2.5 grams, the flip-flop circuits 80 and 81 are 4013B buffered CMOS D-type flip-flops, and the timers 82 and 83 are 555 timers. The horn signal waveform A may have a frequency of about 2,500 Hz, while the time periods of the timer circuits 82 and 83 may, respectively, be approximately 0.2 seconds and 0.7 seconds. While a pulsating operation of the motor 55 has been illustrated, a continuous operation could also be used to produce a continuous vibration as long as the reference torque level is exceeded.

From the foregoing, it can be seen that there has been provided an improved electronic torque wrench which affords an unambiguous tactile indication when the applied torque exceeds a predetermined reference torque level.

We claim:

1. In a torque wrench having sensing apparatus for producing an output signal when the torque transmitted to an associated workpiece equals or exceeds a predetermined torque level, the improvement comprising: generating means for producing a repetitive cyclical tactile indication, and control means responsive to said output signal for activating said generating means.

2. The torque wrench of claim 1, wherein said generating means includes vibratory means.

3. The torque wrench of claim 2, wherein said vibratory means is mechanically coupled to said wrench for effecting vibration thereof.

4. The torque wrench of claim 3, wherein said torque wrench includes a handle portion, said vibratory means being mechanically coupled to said handle portion for effecting vibration thereof.

5. The torque wrench of claim 4, wherein said handle portion defines a cavity therein, said vibratory means and said control means being disposed in said cavity.

6. The torque wrench of claim 1, wherein said control means effects intermittent operation of said generating means for producing an intermittent tactile indication.

7. In an electronic torque wrench having a handle portion and an electronic sensor for producing an electrical output signal when the torque transmitted to an associated workpiece equals or exceeds a predetermined torque level, the improvement comprising: electric motor means mechanically coupled to said handle portion and having a rotatable output shaft, mass means eccentrically mounted on said shaft for rotation therewith to cause vibration of said motor means and said handle portion, and control circuit means responsive to said output signal for activating said motor means.

8. The torque wrench of claim 7, wherein the electronic sensor includes a strain gauge assembly producing a strain signal and a comparator for comparing said strain signal with a predetermined reference level.

9. The torque wrench of claim 7, wherein said motor means includes a DC motor.

10. The torque wrench of claim 7, wherein said output signal is an analog signal.

11. The torque wrench of claim 10, wherein said output signal is an AC signal.

12. The torque wrench of claim 7, wherein said control circuit means effects intermittent operation of said motor means.

13. The torque wrench of claim 7, and further comprising battery means for providing power to the electronic sensor and to said motor means and to said control circuit means.

14. In an electronic torque wrench having a flexure beam and a hollow handle portion coupled to the beam and defining a cavity and an electronic sensor coupled to the beam and responsive to flexure thereof for producing an output signal when the torque transmitted to an associated workpiece equals or exceeds a predetermined torque level, the improvement comprising: electric motor means disposed in the cavity and mechanically coupled to the handle portion and having a rotatable output shaft, mass means eccentrically mounted on said shaft for rotation therewith to cause vibration of said motor means and said handle portion, control circuit means disposed in said cavity and responsive to said output signal for activating said motor means, and power supply means disposed in said cavity for providing power to the sensor and to said control circuit means and said electric motor means.

15. The torque wrench of claim 14, wherein said motor means includes a DC motor.

16. The torque wrench of claim 14, wherein said power supply means includes a battery.

17. The torque wrench of claim 14, and further including holder means providing a mechanical coupling between said motor means and the handle portion.

18. The torque wrench of claim 14, wherein said control circuit means effects intermittent operation of said motor means.

19. The torque wrench of claim 18, wherein said control circuit means includes means for selectively varying the on and off periods of said motor means.

20. The torque wrench of claim 14, wherein said output signal is an AC signal.

* * * * *